US008292129B2

(12) United States Patent
Stadelhofer et al.

(10) Patent No.: US 8,292,129 B2
(45) Date of Patent: Oct. 23, 2012

(54) DISPENSING DEVICE

(75) Inventors: Peter Stadelhofer, Singen (DE); Juergen Greiner-Perth, Gottmardingen (DE)

(73) Assignee: Ing. Erich Pfeiffer GmbH, Radolfzell (DE)

( * ) Notice: Subject to any disclaimer, the term of this patent is extended or adjusted under 35 U.S.C. 154(b) by 408 days.

(21) Appl. No.: 12/657,081

(22) Filed: Jan. 13, 2010

(65) Prior Publication Data

US 2010/0187260 A1 Jul. 29, 2010

(30) Foreign Application Priority Data

Jan. 23, 2009 (DE) ..... 10 2009 006 430

(51) Int. Cl.

| | |
|---|---|
| ***B65D 37/00*** | (2006.01) |
| ***B65D 47/00*** | (2006.01) |
| ***B67D 7/06*** | (2010.01) |
| ***B67D 3/00*** | (2006.01) |

(52) U.S. Cl. ..... 222/207; 222/182; 222/562

(58) Field of Classification Search ..... 222/189.09, 222/207, 256, 372, 383.1, 562

See application file for complete search history.

(56) References Cited

U.S. PATENT DOCUMENTS

| | | | | | |
|---|---|---|---|---|---|
| 3,221,945 | A | | 12/1965 | Davis, Jr. | |
| 3,865,279 | A | | 2/1975 | James | |
| 4,017,031 | A | * | 4/1977 | Kishi et al. | 239/333 |
| 4,413,753 | A | * | 11/1983 | Stock | 222/149 |
| 4,883,471 | A | | 11/1989 | Braginetz et al. | |
| 4,971,470 | A | * | 11/1990 | Moeck et al. | 401/150 |
| 5,366,122 | A | | 11/1994 | Guentert et al. | |
| 5,429,275 | A | * | 7/1995 | Katz | 222/108 |
| 5,641,097 | A | * | 6/1997 | Renault et al. | 222/321.2 |
| 5,709,325 | A | * | 1/1998 | Renault et al. | 222/383.1 |
| 5,829,640 | A | * | 11/1998 | Hershey et al. | 222/153.13 |
| 5,829,645 | A | * | 11/1998 | Hennemann | 222/189.09 |
| 6,000,580 | A | * | 12/1999 | Nilson | 222/108 |
| 6,055,979 | A | | 5/2000 | Fuchs | |
| 6,405,903 | B2 | * | 6/2002 | Stadelhofer | 222/309 |
| 6,527,144 | B2 | * | 3/2003 | Ritsche et al. | 222/162 |
| 6,666,355 | B2 | * | 12/2003 | Padar | 222/152 |
| 6,672,479 | B2 | * | 1/2004 | Shiraishi et al. | 222/105 |

(Continued)

FOREIGN PATENT DOCUMENTS

| | | |
|---|---|---|
| DE | 2 332 076 | 1/1974 |

(Continued)

OTHER PUBLICATIONS

European Patent Office Search Report dated Apr. 19, 2011 (5 pages) with English translation of category of cited documents cited on the European Patent Office Search Report.

(Continued)

*Primary Examiner* — Kevin P Shaver
*Assistant Examiner* — Vishal Pancholi
(74) *Attorney, Agent, or Firm* — Flynn, Thiel, Boutell & Tanis, P.C.

(57) ABSTRACT

A dispensing device for liquid media having a housing, a medium reservoir, an outlet opening for dispensing the medium and an inlet opening for intake of air for the purpose of volume equalization in the medium reservoir, wherein a cap is provided that is fittable onto the housing and protects the outlet opening when in the fitted state. The cap closes the inlet opening in gas-tight manner from an environment on the one hand and from the outlet opening on the other hand.

4 Claims, 2 Drawing Sheets

U.S. PATENT DOCUMENTS

| | | | | |
|---|---|---|---|---|
| 6,851,583 | B2 * | 2/2005 | Masuzzo et al. | 222/321.6 |
| 6,910,603 | B2 * | 6/2005 | Smith | 222/153.13 |
| 7,201,296 | B2 * | 4/2007 | Graf | 222/321.9 |
| 7,275,665 | B2 * | 10/2007 | Young | 222/525 |
| 7,628,298 | B2 * | 12/2009 | Dewig et al. | 222/562 |
| 2006/0011663 | A1 * | 1/2006 | Greiner-Perth | 222/383.1 |
| 2007/0045347 | A1 * | 3/2007 | Auer | 222/207 |
| 2007/0102455 | A1 * | 5/2007 | Stark et al. | 222/207 |
| 2007/0145077 | A1 * | 6/2007 | Harrold | 222/256 |
| 2007/0210121 | A1 * | 9/2007 | Stadelhofer et al. | 222/383.1 |
| 2007/0284393 | A1 * | 12/2007 | Ritsche et al. | 222/189.09 |
| 2008/0029547 | A1 * | 2/2008 | Yuan | 222/207 |
| 2008/0118299 | A1 * | 5/2008 | Py et al. | 401/263 |
| 2008/0237264 | A1 * | 10/2008 | Auerbach et al. | 222/162 |
| 2009/0008415 | A1 * | 1/2009 | Ohshima | 222/383.1 |

FOREIGN PATENT DOCUMENTS

| | | | |
|---|---|---|---|
| DE | 41 28 295 | A1 | 3/1993 |
| DE | 196 13 185 | A1 | 10/1997 |
| EP | 0 799 646 | A2 | 10/1997 |

OTHER PUBLICATIONS

Supplemental German Search Report for corresponding German Application No. 10 2009 006 430.3 dated Nov. 18, 2011.

Search Report for corresponding German Application No. 10 2009 006 430.3 dated Aug. 14, 2009.

* cited by examiner

DISPENSING DEVICE

FIELD OF THE INVENTION

The invention relates to a dispensing device for liquid media, having a housing, a medium reservoir, an outlet opening for dispensing the medium and an inlet opening for intake of air for the purpose of volume equalization in the medium reservoir. The dispensing device has a cap fittable onto the housing and protecting the outlet opening when in the fitted state.

BACKGROUND OF THE INVENTION

Generic dispensing devices are known from the prior art. It is provided in the case of such devices that medium is dispensed from a medium reservoir by means of a pump device or another conveying device through the outlet opening to an environment. This serves in particular to dispense pharmaceuticals and cosmetics. The dispensing operation reduces the amount of medium in the medium reservoir. To prevent a negative pressure forming in the medium reservoir as a result, which is a hindrance to further dispensing operations, generic dispensing devices have an inlet opening through which air can flow into the dispensing device and into the medium reservoir where it remains for replacement of the dispensed medium and leads to a pressure equalization.

What is problematic here is that the inlet opening and the connection of the inlet opening to the medium reservoir permit an escape of the medium in gaseous form. If therefore the dispensing device is kept in storage for a lengthy period, a relevant quantity of the medium can escape through the inlet opening. Not only is this is a problem due to the loss of the medium in itself, but additionally it results in the concentration of active substances remaining in the medium reservoir being altered, so that the dosage in accordance with the intended purpose is no longer assured during dispensing.

SUMMARY OF THE INVENTION

The object underlying the invention is therefore to improve a dispensing device by which the drawbacks of the prior art are reduced.

This problem is solved in accordance with the invention in that the cap closes the inlet opening in gas-tight manner from a surrounding atmosphere on the one hand and from the outlet opening on the other hand.

The cap of the dispenser, for example of a dispenser for ophthalmic applications, is accordingly designed in the embodiment in accordance with the invention so that it protects not only the outlet opening, for example from contact with contaminated surfaces, but also ensures at the same time protection of the inlet opening and closes off the inlet opening in gas-tight manner from the surrounding atmosphere and from the outlet opening.

When the cap is fitted, the inlet opening is accordingly firstly closed gas-tight from the surrounding atmosphere. Since a gas-tight encapsulation of the inlet opening is additionally achieved from the outlet opening too, it is possible to design the cap so that a gas-open connection between the outlet opening and the surrounding atmosphere is provided for drying purposes, while at the same time the inlet opening is closed off gas-tight from the surrounding atmosphere.

The inlet opening can be designed as a penetration inside the housing serving only for air intake purposes. It is however particularly advantageous when the inlet opening is provided in the area of an actuating button movable relative to the housing. It is particularly preferred here that the inlet opening is designed as an inlet gap between the actuating button on the one hand and the housing on the other. With a design of this type, the actuating button itself is also accordingly covered by the cap, so that it is also ensured that an actuation of the dispensing device is not possible while the protective cap is fitted.

In the simplest case, the cap can be designed for closing the inlet opening from the surrounding atmosphere in such a way that it has a surface section which in the fitted state of the cap is in all-round contact with the edges of the inlet opening and covers the inlet opening. As a result, the inlet opening is accordingly directly closed.

Alternatively, the cap is designed such that in its fitted state it limits together with the housing a space closed off gas-tight from the surrounding atmosphere, wherein the inlet opening opens into this closed space. A design of this type, according to which the cap does not directly close the inlet opening, but connects it to a space closed off from the outside and between the inside of the cap and the housing, does not require very precise positioning of the cap in order to ensure sealing of the inlet opening. Instead of the cap being in direct contact with the housing in the area of the inlet opening, it is in accordance with this embodiment at a distance from the inlet opening in the area of a contact track on the housing. This allows larger areas to be provided on the housing and on the cap where the housing and the cap are in a sealing touch contact. For that reason, even when the cap has been fitted with little care, the required sealing of the inlet opening is assured. The contact track along which the cap is in contact with the housing can for example surround in approximately circular form the inlet opening at a distance from 5 mm to 10 mm, for example.

The contact track along which touch contact is achieved between the cap and the housing is preferably provided near an area of the cap and of the housing largely cylindrical relative to the fitting direction of the cap. An area tapering or flaring with an angle of less than 10° is also regarded as a largely cylindrical area in this case. Thanks to this largely cylindrical design in the area of the contact track, sealing is achieved even when the cap is pushed on not far enough or too far.

It is particularly advantageous when the cap in the fitted state is in contact with the housing along two all-round contact tracks, wherein the closed-off space is provided between the two contact tracks. With a design of this type, the housing and the cap are matched to one another such that when the cap is fitted, a contact between the cap and the housing in the areas of the first and of the second contact track is obtained at approximately the same time. These two contact tracks formed by the touch contact between the cap and the housing each surround the housing and thus define an annular space closed off from the surrounding atmosphere. The contact tracks run preferably in a plane, the normal vectors of which are aligned parallel to the push-on direction of the cap. In the design with two contact tracks too, it is regarded as advantageous when at least one of the contact tracks is provided in a largely cylindrical area of the housing and of the cap.

In this embodiment with two contact tracks, the cap can be pushed onto the housing in any angular setting relatively to the push-on direction, since due to the all-round annular space it is assured that the inlet opening opens into the annular space regardless of the angular setting.

The cap of a dispensing device in accordance with the invention protects the outlet opening at least against any mechanical damage. It is shaped such that a touch contact of the outlet opening with surfaces in the environment of the dispensing device are effectively prevented when the cap has been fitted. The cap can be designed such that the outlet opening too is closed gas-tight from the surrounding atmosphere. To enable drying of the outlet opening after a dispensing operation, the cap is however preferably designed such that it permits an air flow to the outlet opening even when in the fitted state. To do so, it is preferably provided that the cap has at least one vent opening via which the outlet opening is connected to the surrounding atmosphere.

BRIEF DESCRIPTION OF THE DRAWINGS

Further aspects and advantages of the invention can be gathered not only from the claims, but also from the following description of a preferred embodiment of the invention explained in more detail using the figures. The drawings show in:

DETAILED DESCRIPTION OF THE EMBODIMENT

Figure 1:
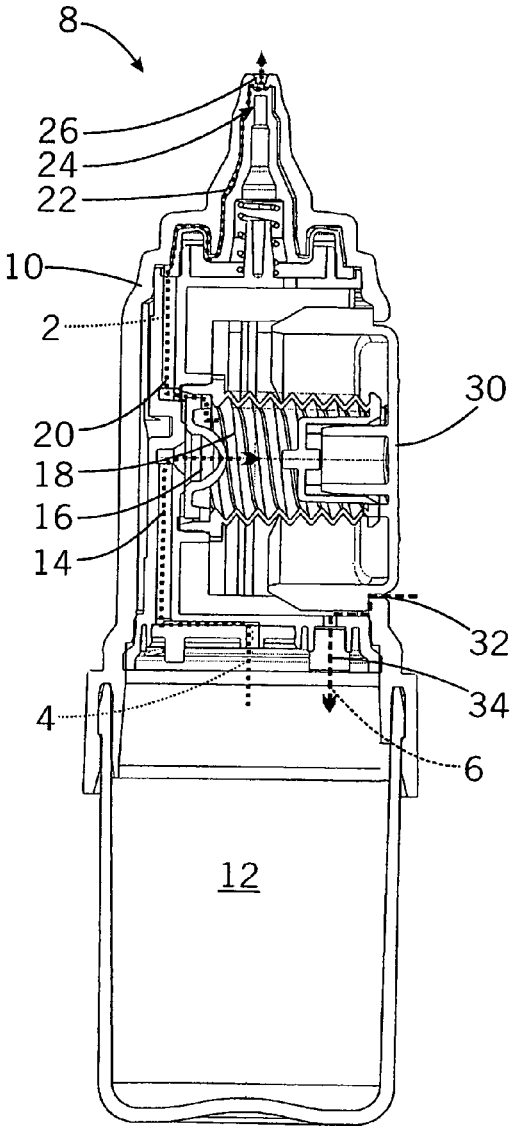
FIG. 1 an embodiment of a dispensing device in accordance with the invention in a sectional view without the cap fitted, FIG. 2 the dispensing device of FIG. 1 in a perspective view, FIG. 3 a cap intended for the dispensing device of FIGS. 1 and 2, FIG. 4 the dispensing device of FIGS. 1 and 2 with the cap fitted.
Figure 2:
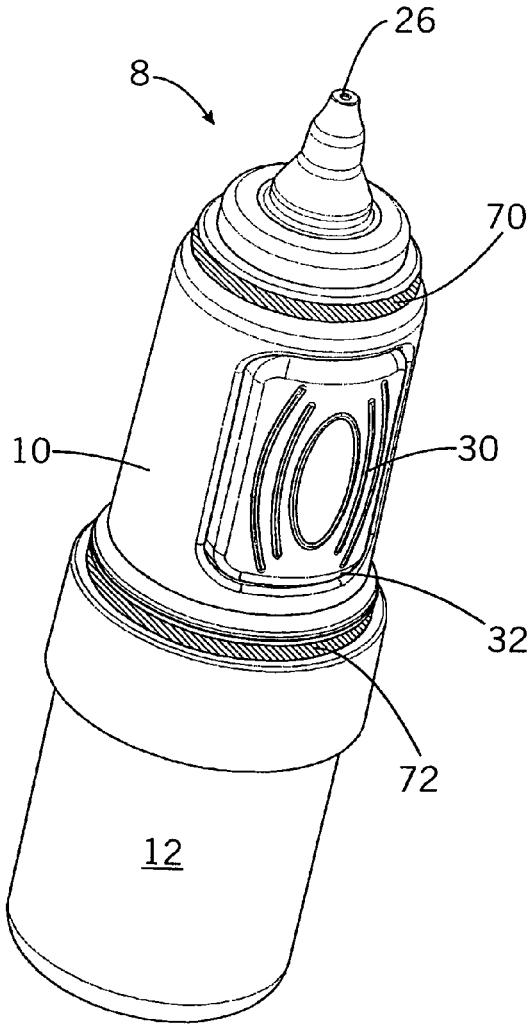

FIGS. 1 and 2 show a dispensing device 8 in accordance with the invention in a state of use in which a cap 60 of the dispensing device 8 has been removed. The dispensing device 8 has a medium reservoir 12 which is connected via a duct 14 and an inlet valve 16 to a pump chamber 18. An outlet duct 20 opening into an outlet chamber 22 is connected on the outlet side of the pump chamber 18. An outlet opening 26 is connected to the outlet chamber 22 and in the state in FIG. 1 is closed by a pressure-controlled outlet valve 24 inside the housing 10 of the dispensing device 8.

To operate the dispensing device 8, an actuating button 30 is provided that is movable in the radial direction of the dispensing device 8 and can be used by an application of force in order to reduce the volume of the pump chamber 18 and thereby force the medium out of the pump chamber 18 and into the outlet duct 20. This in turn leads to a pressure increase in the outlet chamber 22, thereby opening the outlet valve 24 and permitting dispensing of the medium through the outlet opening 26. The path of the medium from the pump chamber 18 to the outlet opening 26 is indicated in FIG. 1 by the dotted arrow 2.

After the dispensing operation, the actuating button 30 returns to its initial state, with the volume inside the pump chamber 18 increasing again. Since the outlet valve 24 is closed again at this time, this volume increase leads to an intake of the medium from the medium reservoir 12 through the duct 14 and the inlet valve 16. The path of the medium from the medium reservoir 12 into the pump chamber 18 is made clear by the dotted arrow 4 in FIG. 1.

The intake of the medium from the medium reservoir 12 when the pump chamber 18 is refilled leads to a negative pressure inside the medium reservoir 12. To equalize this negative pressure again, it is provided in accordance with the intended purpose that air from the surrounding atmosphere is sucked into the medium reservoir 12. This air can penetrate through a gap 32 between the housing 10 and the actuating button 30 into the housing 10 and from there through a filter unit 34 into the medium reservoir 12. The path taken by the air from the surrounding atmosphere to the medium reservoir 12 is made clear by the dashed arrow 6.

Figure 3:
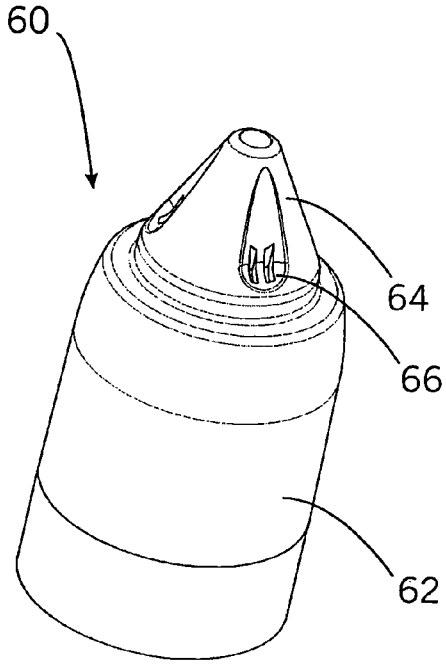

Even if an evaporation of the medium inside the medium reservoir 12 is reduced because of the stated filter unit 34, it is nevertheless desirable to further reduce the evaporation of the medium inside the medium reservoir 12. To do so, the cap 60 shown in FIG. 3 is provided. The cap 60 has a lower largely cylindrical section 62 and an upper conical section 64 adjacent to it. Vent openings 66 are provided in the area of the conical section 64.

Figure 4:
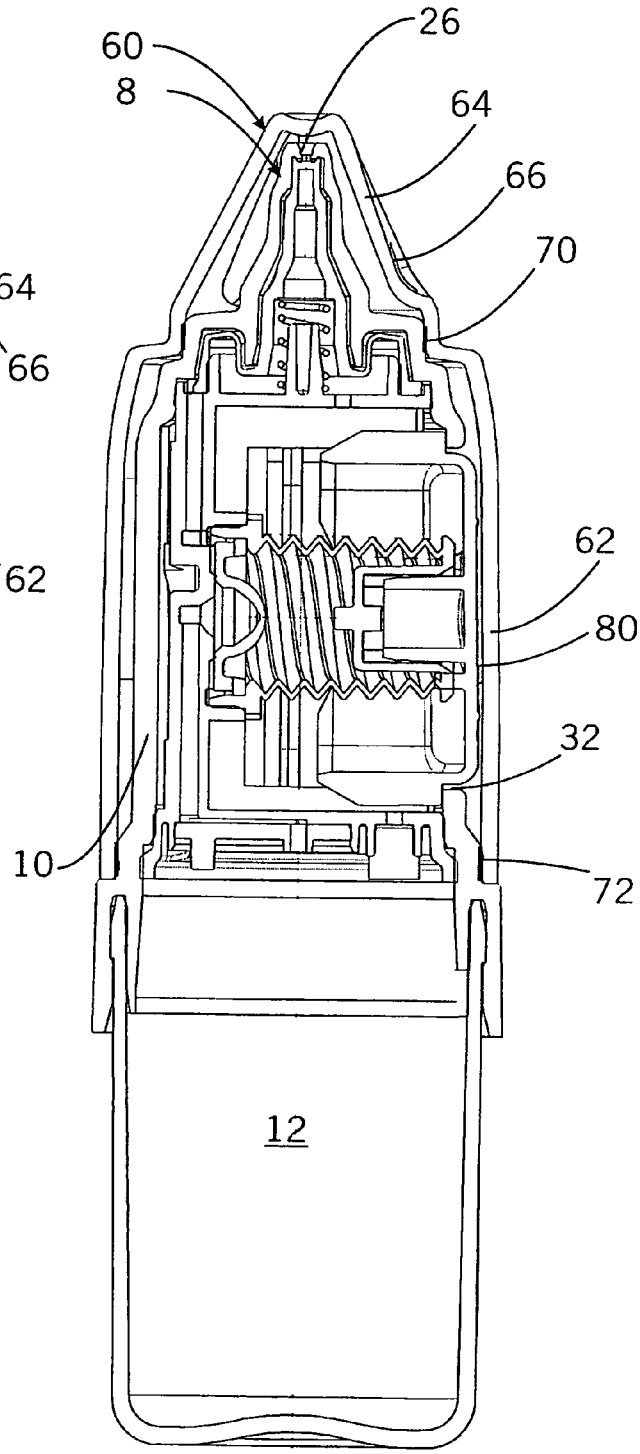

The cap 60 can be pushed onto the dispensing device 8 of FIGS. 1 and 2 in the manner shown in FIG. 4. The shape of the cap 60 is here adapted to the shape of the housing 10 such that in the area of two all-round contact tracks 70, 72 shown in particular in FIG. 2 the cap 60 comes into contact with the housing 10. Between the contact tracks 70 and 72, the housing 10 and the cylindrical section 62 of the cap 60 are at a distance from one another and limit jointly an intermediate space 80 which is closed off gas-tight from the surrounding atmosphere by the contact tracks 70, 72.

To achieve a required low positioning accuracy of the cap 60 relative to the housing 10, the contact tracks 70, 72 are provided in the area of approximately cylindrical areas of the cap 60 and the housing 10. This ensures that even when an all-round contact between the cap 60 and the housing 10 already exists at one of the two contact tracks 70, 72, the cap 60 can be pushed further onto the housing 10 without a markedly higher force being exerted, so that an all-round contact is achieved at the second contact track too.

In the fitted state of the cap 60, shown in FIG. 4, a complete sealing of the inlet gap 32 opening into this annular space 80 from the surrounding atmosphere is achieved by the contact tracks 70, 72 and the all-round annular space 80 formed thereby. Only a negligibly small proportion of the medium therefore escapes from the medium reservoir 12, even if the dispensing device is stored for a long period.

While it is desirable to close off the inlet opening 32 gas-tight, this is not desirable with regard to the outlet opening 26 in the present dispensing device. The outlet opening 26 is sufficiently protected against an evaporation of the medium by the outlet valve 24. It is however advantageous if after a dispensing operation remaining media still in the area of the outlet opening 26 can dry even when the cap 60 is already fitted. For this purpose, the already described vent openings 66 are provided in the conical section 64 of the cap 60. They permit an air exchange and hence rapid drying of the outlet opening 26. Thanks to the contact track 70, this design with vent openings 66 does not however involve any loss of the gas-tight design of the inlet opening 32.

The invention claimed is:

1. Dispensing device for dispensing liquid media comprising:

a housing;

a medium reservoir;

an outlet opening for dispensing the medium; and an inlet opening for intake of air for volume equalization in the medium reservoir;

wherein a cap is provided that is removably fittable onto the housing and protects the outlet opening when in a fitted state;

wherein the cap closes the inlet opening in a gas-tight manner from a surrounding atmosphere and from the outlet opening; and wherein the cap in the fitted state limits together with the housing a space closed-off gas-tight from the surrounding atmosphere, wherein the inlet opening opens into the space.

2. Dispensing device according to claim 1, wherein the inlet opening is provided in an area of an actuating button movable relative to the housing and designed as an inlet gap between the actuating button and the housing.

3. Dispensing device for dispensing liquid media comprising:

a housing;

a medium reservoir;

an outlet opening for dispensing the medium; and an inlet opening for intake of air for volume equalization in the medium reservoir;

wherein a cap is provided that is removably fittable onto the housing and protects the outlet opening when in a fitted state;

wherein the cap closes the inlet opening in a gas-tight manner from a surrounding atmosphere and from the outlet opening;

wherein the cap in the fitted state limits together with the housing a space closed-off gas-tight from the surrounding atmosphere, wherein the inlet opening opens into the space; and wherein the cap in the fitted state is in contact with the housing along two all-round contact tracks, with the space being provided between the two contact tracks.

4. Dispensing device according to claim 1, wherein the cap has at least one vent opening via which the outlet opening is connected to the surrounding atmosphere.

* * * * *